US005087142A

United States Patent [19]

Suzuki et al.

[11] Patent Number: 5,087,142

[45] Date of Patent: Feb. 11, 1992

[54] SHEET FEEDER FOR PRINTERS INCLUDING MEANS TO CONTROL AND DETECT THE SHEET

[75] Inventors: Hiroshi Suzuki; Eiji Arakawa; Kazuhiko Takagi, all of Nagoya; Hiroshi Watanabe, Kaizu, all of Japan

[73] Assignee: Brother Kogyo Kabushiki Kaisha, Aichi, Japan

[21] Appl. No.: 476,705

[22] Filed: Feb. 8, 1990

[30] Foreign Application Priority Data

| | | | |
|---|---|---|---|
| Feb. 8, 1989 | [JP] | Japan | 1-29454 |
| Mar. 3, 1989 | [JP] | Japan | 1-52574 |
| Mar. 8, 1989 | [JP] | Japan | 1-55393 |

[51] Int. Cl.[5] ..... B41J 11/50

[52] U.S. Cl. ..... 400/616; 400/582; 400/607.2; 400/708; 400/712

[58] Field of Search ..... 400/616, 616.1, 636.1, 400/712, 639.1, 708, 582, 583, 600.2, 600.3, 607, 607.2

[56] References Cited

U.S. PATENT DOCUMENTS

| | | | |
|---|---|---|---|
| 4,452,543 | 6/1984 | Adkisson et al. | 400/639.1 |
| 4,498,795 | 2/1985 | Tatara | 400/636.1 |
| 4,514,740 | 4/1985 | Fujiwara | 400/636.1 |
| 4,522,520 | 6/1985 | Takenoya et al. | 400/636.1 |
| 4,615,630 | 10/1986 | Maeshima | 400/596 |
| 4,647,233 | 3/1987 | Noda et al. | 400/600.2 |
| 4,688,957 | 8/1987 | Prevignano | 400/616 |
| 4,778,296 | 10/1988 | Takahashi | 400/712 |
| 4,847,633 | 7/1989 | Piatt et al. | 400/605 |
| 4,875,790 | 10/1989 | Karube et al. | 400/708 |
| 4,929,104 | 5/1990 | Yokoi et al. | 400/605 |
| 5,026,183 | 6/1991 | Oshima et al. | 400/605 |
| 5,030,024 | 7/1991 | Seshimo | 400/605 |

FOREIGN PATENT DOCUMENTS

| | | | |
|---|---|---|---|
| 0084958 | 4/1988 | Japan | 400/636.1 |
| 2125339 | 3/1984 | United Kingdom | 400/616 |

*Primary Examiner*—Edgar S. Burr
*Assistant Examiner*—John S. Hilten
*Attorney, Agent, or Firm*—Oliff & Berridge

[57] ABSTRACT

A sheet feeder for a printer selectively feeds a continuous sheet and a cut sheet to a printing mechanism including a platen and a print head. The continuous sheet is fed by a pair of pin tractors and the platen while the cut sheet is fed only by the platen. At least one sheet presser roller is provided for guiding the feeding of the cut sheet, which moves toward the platen when the cut sheet is fed so as to hold the latter against the platen, and moves away from the platen when the continuous sheet is fed. A switching lever sets the sheet feed mode, which when moved to a first position causes to feed the cut sheet by rotating the platen and when moved to a second position causes to feed the continuous sheet by rotating both the pin tractors and the platen. In order to prevent the sheet from jamming or tearing off due to erroneous operation of the switching lever, a buzzer alerts the operator of the erroneous operation if the switching lever is eventually moved from the first to the second position or vice versa when a relevant sheet has been loaded in the printing mechanism. A paper bail is provided for retaining the sheet onto the platen, with which the cut sheet is retained with a stronger force so that the bottom portion of the cut sheet may be appropriately printed by the print head.

17 Claims, 7 Drawing Sheets

SHEET FEEDER FOR PRINTERS INCLUDING MEANS TO CONTROL AND DETECT THE SHEET

BACKGROUND OF THE INVENTION

The present invention relates to a sheet feeder for use in a printer, which selectively feeds a continuous sheet and a cut sheet to a printing section in a printer.

A known sheet feeder for use in a printer comprise a platen, sheet presser rollers which can be held against and released from the platen, pin tractors for feeding a continuous sheet toward the platen, and an operating means for selecting either a continuous sheet feed mode or a cut sheet feed mode on the sheet feeder. When the operating means, such as a change-over lever, selects the continuous sheet feed mode, the sheet presser rollers are spaced away from the platen, and the pin tractors and the platen are actuated in synchronism with each other to thereby feed a continuous sheet. When the operating means selects the cut sheet feed mode, the pin tractors are inactivated and the sheet presser rollers are held against the platen. A cut sheet is fed in accordance with the rotations of the platen while being pressed by the sheet presser rollers against the platen.

In the known sheet feeder, the operating means is capable of switching between the different feed modes even during the sheet feeding operation. If the operating means is operated to select the cut sheet feed mode while the continuous sheet is being fed, then the pin tractor is stopped and the sheet presser rollers are held against the platen, with only the platen being actuated. Therefore, the continuous sheet can not be fed normally, otherwise it may be tore off, since the pin tractor serves as a load when the continuous sheet is to be fed by the platen while being pressed against the platen by the presser rollers. Conversely, if the operating means is operated to select the continuous sheet feed mode while the cut sheet is being fed, then the sheet presser rollers are separated from the platen and the pin tractors are actuated in synchronism with the platen. Consequently, the cut sheet can no longer be fed, and the continuous sheet is fed toward the platen by the pin tractor. The continuous sheet thus fed impinges upon the cut sheet, thereby causing a paper jam.

Further, in the known paper feeder, when the continuous sheet feed mode is changed to the cut sheet feed mode, or vice versa, it has been necessary that a control signal applied to the printing section or other signals associated with the sheet feed mode be changed depending upon the selected sheet feed mode. To this effect, not only the operating means but also a change-over switch provided separately from the operating means need to be manipulated when the sheet feed mode is to be changed from one to the other. The manipulations of both the operating means and the change-over switch are intricate for the operator. In addition, due to the need for providing another operating means for the change-over switch, the number of parts constituting the printer is increased and this causes to increase the manufacturing cost of the printer.

The known paper feeder is further provided with a paper bail which serves to retain a sheet of paper on the platen so that the sheet of paper supported on the platen is not released therefrom due to the resiliency. The retaining force imparted by the paper bail is constant regardless of whether the sheet of paper supported on the platen is the cut sheet or the continuous sheet.

However, in the case of using the continuous paper, the paper is mainly fed by the pin tractor and the paper bail only serves to pull the sheet so as not to be slackened. As the peripheral speed of the platen is set higher than the feeding speed by the pin tractor, the retaining force by the paper bail must be as weak as a slippage occurs between the platen and the continuous sheet. If the retaining force by the paper bail is too strong, the sheet of paper is pulled excessively, whereby a driving pulley and a driven pulley of the pin tractor are imposed undue load. As a result, the sheet of paper may be tore off or the perforations on the continuous sheet may be disengaged from the pins on the pin tractor. Therefore, the retaining force by the paper bail must be set weaker when the continuous sheet is to be fed.

On the other hand, in the case of using the cut sheet, particularly in the case of a small-size and highly resilient cut sheet, such as post card, to print the end portion of the paper, it is required that the sheet be fed only by the paper bail when the trailing end of the sheet is disengaged from the presser rollers. If the retaining force is not strong enough, the printing lines at the bottom portion of the paper tend to be displaced or the paper feeding cannot be smoothly achieved. Therefore, the retaining force must be set stronger when the cut sheet is to be fed.

SUMMARY OF THE INVENTION

The present invention has been made to solve the aforementioned problems accompanying the conventional sheet feeder, and it is an object of the present invention to provide a sheet feeder for a printer, which can prevent a sheet from being tore off, a sheet feed failure, and a paper jam, which would otherwise result from an erroneous operation of an operating means.

Another object of the present invention is to provide a sheet feeder in which the sheet feed mode switching operation is simplified by reducing the number of manipulations needed to effect the switching between a continuous sheet feed mode and a cut sheet feed mode.

Still another object of the present invention is to provide a sheet feeder which can be fabricated with a reduced number of components to thus reduce the cost for manufacturing the same.

Yet another object of the present invention is to provide a sheet feeder in which the retaining force of a paper bail against a platen can be varied depending upon the cases where printing is carried on a continuous sheet and a cut sheet to thus ensure printing on the bottom portion of the cut sheet and smooth sheet feeding thereof.

To achieve the above and other objects, there is provided in accordance with one aspect of the present invention a sheet feeder for a printer comprising a frame, a printing mechanism including a platen rotatably supported on the frame and a print head reciprocally movable along the platen, the print mechanism carrying out printing on a sheet loaded in the printing mechanism, a drive source, continuous sheet feed means connected to the drive source for feeding a continuous sheet, cut sheet feed means connected to the drive source for feeding a cut sheet, switching means for connecting the drive source to selective one of the continuous sheet feed means and the cut sheet feed means, the switching means being movable between a first position and a second position wherein the continuous sheet feed means is selectively driven when the switching means is in the first position and the cut sheet feed means is selectively driven when the switching means is in the second position, position detecting means for detecting the position of the switching means and indicating the position thus detected, sheet detecting means for detecting the sheet loaded in the printing mechanism, indicator means, and control means for actuating the indicator means when the position detecting means indicates that the position of the switching means is moved while the sheet detecting means is detecting the sheet loaded in the printing mechanism.

Depending on the continuous sheet or the cut sheet to be used, the switching means is moved from the first to the second position or vice versa. While the sheet detecting means is detecting the continuous sheet or the cut sheet whichever it has been loaded in the printing mechanism, the control means determines whether the switching means is moved or not based on the output of the position detecting means. When it is determined that the switching means is moved to switch the continuous sheet feed means or the cut sheet feed means, the control means actuates the indicator means to alert the operator of the erroneous operation of the switching means.

In accordance with another aspect of the present invention, there is provided a sheet feeder for a printer comprising a frame, a printing mechanism including a platen rotatably supported on the frame and a print head reciprocally movable along the platen, the print mechanism carrying out printing on a continuous sheet and a cut sheet whichever it is loaded in the printing mechanism, at least one sheet presser roller for pressing the sheet loaded in the print mechanism against the platen, the sheet presser roller being movable between a first position and a second position wherein when the cut sheet is being loaded in the printing mechanism, the sheet presser roller is moved to the first position to hold the cut sheet against the platen with a first force and wherein when the continuous sheet is being loaded in the printing mechanism, the sheet presser roller is moved to the second position to hold the continuous sheet against the platen with a second force, the first force being greater than the second force, a pin tractor for feeding the continuous sheet toward the printing mechanism, a drive source for driving the platen and the pin tractor, a power transmission mechanism connected to the drive source and being selectively brought to a first state in which to connect the drive source to the platen and a second state in which to connect the drive source to both the platen and the pin tractor, sheet detecting means for detecting the sheet loaded in the printing mechanism and generating an output a signal indicative of the sheet loaded therein, and a switching lever movable between a third position and a fourth position and operatively coupled to the sheet presser roller, the power transmission mechanism, and the sheet detecting means for jointly actuating the same in accordance with the movement between the third and fourth positions.

The sheet presser roller, the power transmission mechanism and the sheet detecting means are jointly actuated relying upon the movement of the switching lever, whereby the cut sheet feed mode or the continuous sheet feed mode can be set only by operating the switching lever.

According to still another aspect of the present invention, there is provided a printer for a printer comprising a frame, a printing mechanism including a platen rotatably supported on the frame and a print head reciprocally movable along the platen, the print mechanism carrying out printing on a continuous sheet and a cut sheet whichever it is loaded in the printing mechanism, a paper bail disposed in a position vertically displaced from the print head for retaining the sheet onto the platen, a spring having one end attached to the paper bail for imparting a retaining force to the paper bail, a switching member movable between a first position and a second position for changing the sheet to be loaded in the printing mechanism, and a retaining force magnitude changing means connected to another end of the spring for changing a magnitude of the retaining force, and wherein the retaining force magnitude changing means changes the magnitude of the retaining force imparted to the paper bail when the switching member is moved between the first position and the second position.

When the cut sheet is to be printed, the paper bail retains the sheet onto the platen with a greater force by moving the switching member to an appropriate position, whereas when the continuous sheet is to be printed, the paper bail retains the sheet with a weaker force by moving the switching member to the opposite position. Therefore, even if the cut sheet is of a small size and resilient, such as postcard, the print lines at the bottom of the sheet would not be disturbed or displaced.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENTS

Figure 1:
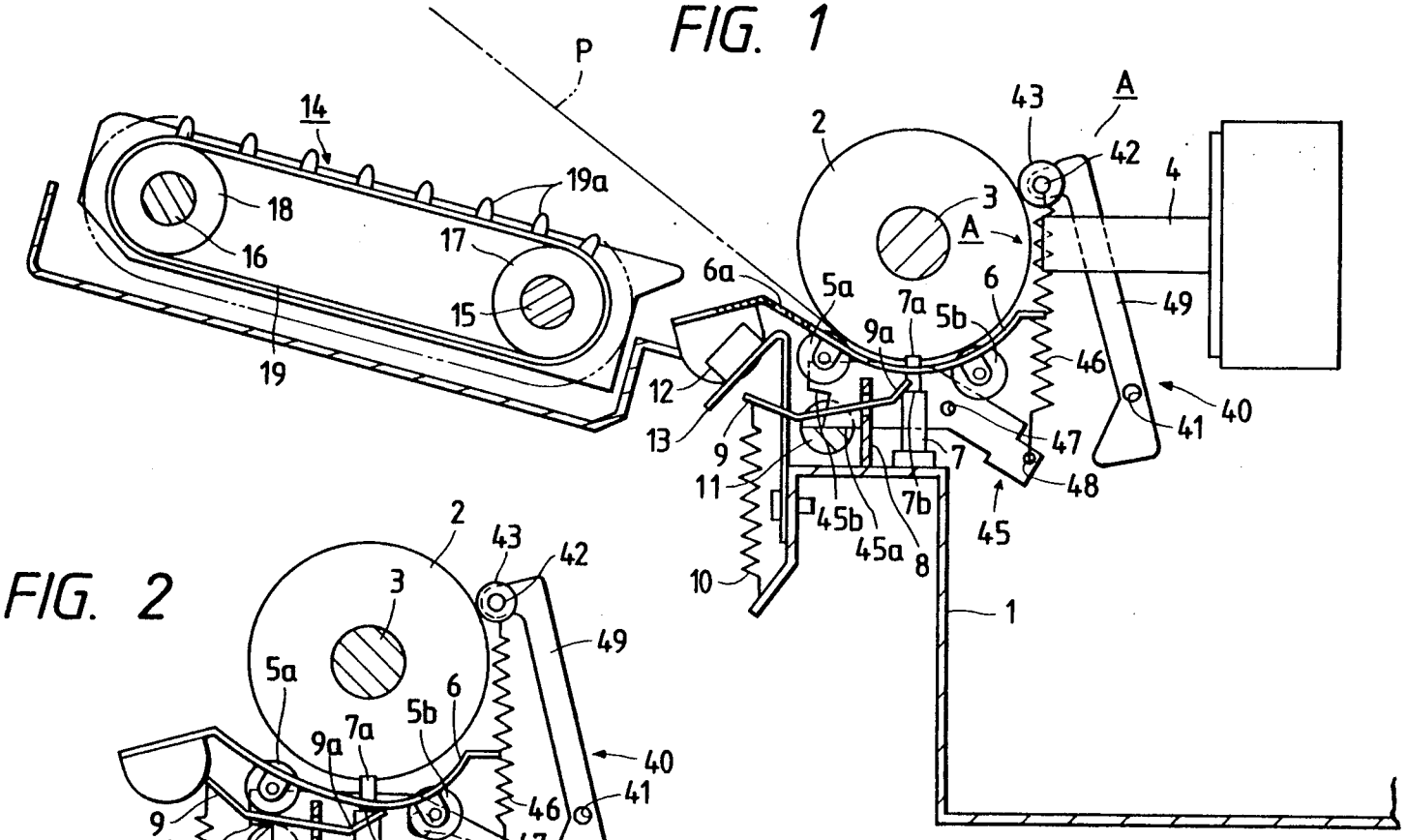
FIG. 1 is a fragmentary sectional side elevational view of a sheet feeder according to an embodiment of the present invention.
Figure 3:
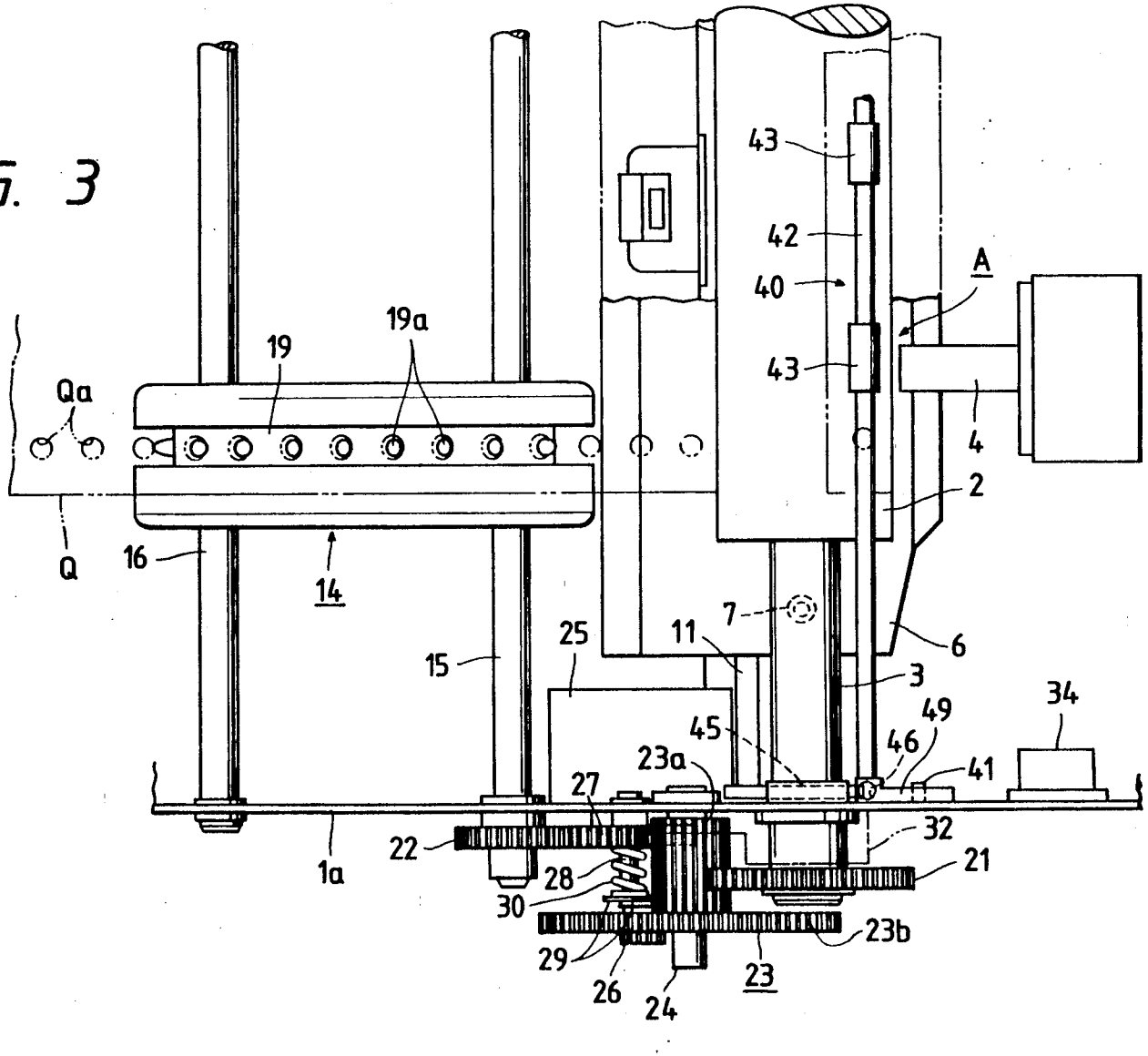
FIG. 3 is a fragmentary plan view of the sheet feeder.

As shown in FIGS. 1 and 3, a platen 2 is disposed in a sheet feed path and extends transversely across the sheet feed path. The platen 2 has a shaft 3 which is rotatably supported between opposing side walls la of a printer frame 1. A print head 4 which is reciprocally movable along the platen 2 is disposed in front of the platen 2 (rightwardly of the platen 2 in FIG. 1). The platen 2 and the print head 4 jointly serve as a printing mechanism A for printing desired information on a cut sheet P or a continuous sheet Q. A sheet guide member 6 on which a plurality of sheet presser rollers 5*a*, 5*b* are rotatably supported is disposed below and extends along the platen 2.

Figure 2:
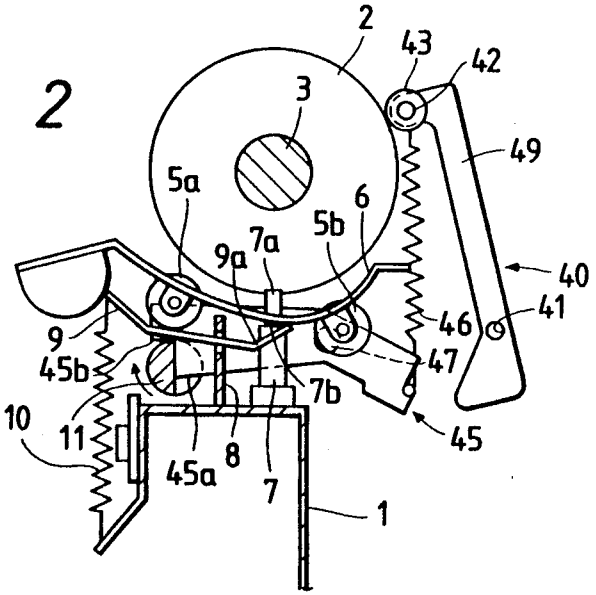
FIG. 2 is a fragmentary sectional side elevational view illustrative of the manner in which sheet presser rollers are brought into and out of contact with a platen.

As shown in FIGS. 1 and 2, the sheet guide member 6 is vertically movably supported on a pair of support pins 7 (only one being shown) disposed below the platen 2 and projecting upwardly from laterally opposite upper surfaces of the printer frame 1. Each of the support pins 7 has a smaller diameter distal end 7*a* and a step 7*b*. The distal ends 7*a* of the support pins 7 extend upwardly through the laterally opposite sides of the sheet guide member 6. The sheet guide member 6 is vertically movable along the length of the distal ends 7*a*. Downward movement of the sheet guide member 6 is limited by the steps 7*b*.

Support projections 8 project upwardly from the laterally opposite upper surfaces of the printer frame 1 below the sheet guide member 6. An operating member 9 which is tiltable to vertically move the sheet guide member 6 is supported on the support projections 8. A tension spring 10 engages an end of the operating member 9 for normally tilting the operating member 9 in a direction to cause an end 9*a* thereof to push the sheet guide member 6 upwardly for thereby holding the sheet presser rollers 5*a*, 5*b* against the platen 2. As operating shaft 11 which is engageable with the operating member 9 is angularly movably supported below the operating member 9 for tilting the operating member 9 in an opposite direction against the bias of the tension spring 10. The operating shaft 11 has a semicircular cross-section and extends between side walls la of the printer frame 1. When the operating member 9 faces the semicircular recess of the operating shaft 11, it is tilted in the direction to push the sheet guide member 6 upwardly under the resiliency of the tension spring 10. As shown in FIG. 2, when the operating shaft 11 is angularly moved in the direction indicated by an arrow, the operating member 9 is pushed upwardly by the circular outer peripheral surface of the operating shaft 11 and tilted about the support projections 8. The sheet guide member 6 is now released from the upward displacement by the end 9*a* of the operating member 9, thus allowing the sheet presser rollers 5*a*, 5*b* to be spaced apart from the platen 2.

As shown in FIGS. 1 and 3, a paper bail 40 is disposed between the side walls la of the printer frame 1 for retaining the cut sheet P and the continuous sheet Q onto the platen 2. As shown in FIG. 1, the paper bail 40 comprises a pair of arms 49 (only one being shown) spaced apart from each other in the transverse direction and rotatably supported at the lower ends thereof through the respective pins 41. As best shown in FIG. 3, a rod 42 is supported between the free ends of the arms 49, which extends in a direction parallel to the platen 2. A plurality of retaining rollers 43 are rotatably supported on the rod 42 in spaced apart relation from one another to thereby retain the sheet P or Q onto the platen 2. The retaining rollers 43 and the rod 42 are disposed in a position vertically spaced from the print head 4 so that the movement of the print head 4 is not bothered. One end of a spring 46 is attached to the rod 42.

In the lower portion of the sheet guide member 6, a pair of thin, retaining force change-over plate 45 are disposed to be rotatable about the respective pins 47. Each of the plates 45 has one end 48 to which another end of the spring 46 is attached. The lower face 45*a* of the plate 45 is in abutment with the operating shaft 11 due to the biasing force of the spring 46.

Figure 12:
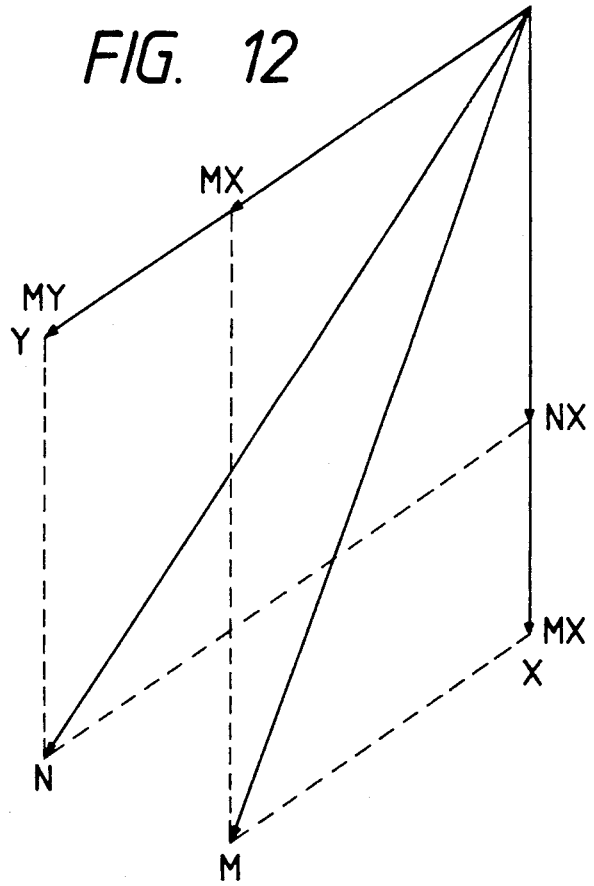
FIG. 12 is a vector diagram illustrative of a retaining force of a paper bail against a platen.
Figure 12:
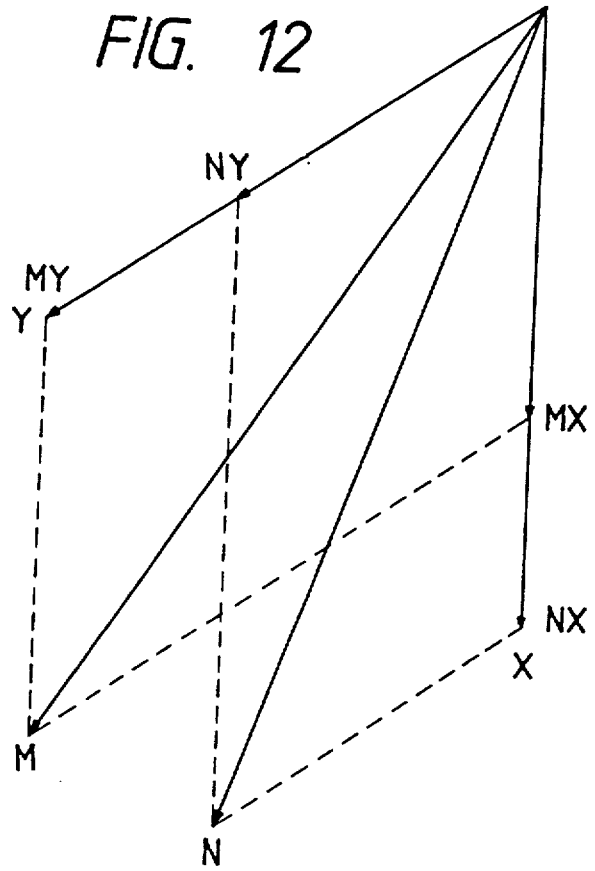

When the sheet presser rollers 5*a*, 5*b* release from the platen 2, the plate 45 is also moved downwardly. The downward movement thereof is, however, limited by the step 45*b*. The movement of the plate 45 will be described while referring to a vector diagram shown in FIG. 12. In FIG. 12, the biasing force of the spring 46 represented by a vector is decomposed to two vector components, one directing toward the pin 41 (X direction) and the other directing toward the center of the platen (Y direction). In the diagram, the point M indicates a first position of the plate 45 at which the sheet presser rollers 5*a*, 5*b* are moved upwardly and held against the platen 2, and the point N indicates a second position of the plate 45 at which the sheet presser rollers 5*a*, 5*b* are moved downwardly and are spaced apart from the platen 2. The magnitudes of the vectors M and N both originating from the position of the pin 44 are equal to each other. When the plate 45 is shifted from the first to the second position in accordance with the rotation of the operating shaft 11, a ratio in magnitude of the Y directional component MY of the vector M to the same directional component NY of the vector N is about 1.57 ($|MY|/|NY| \approx 1.57$). Specifically, when the plate 45 is moved to the second position in accordance with the clockwise rotation of the operating shaft 11, the end portion 48 of the plate 45 to which the spring 46 is attached is shifted toward the platen 2, and as the portion 48 shifts theretoward, the Y directional component of the force of the spring 46 decreases. That is, the retaining force of the paper bail 40 in the case of feeding the cut sheet P becomes about 1.57 times greater than that of the paper bail 40 in the case of feeding the continuous sheet Q.

In this embodiment, the platen 2 and the sheet presser rollers 5*a*, 5*b* serve as a cut sheet feed means for feeding a cut sheet P to the printing mechanism A. The cut sheet P which is gripped by the platen 2 and the sheet presser roller 5 is delivered upon rotation of the platen 2.

As illustrated in FIGS. 1 and 3, a sheet sensor 12 in the form of an optical sensor is fixed to the printer frame 1 by a bracket 13, the sheet sensor 12 being disposed in the sheet feed path upstream of the platen 2 and below the sheet guide member 6. The sheet sensor 12 serves as a sheet detecting means for detecting a sheet loaded in the printing mechanism A. The sheet guide member 6 has a through hole 6*a* defined therein in registry with the sheet sensor 12, which can detect whether there is a sheet or not through the hole 6*a*.

A pair of pin tractor 14 (only one shown) is disposed in the sheet feed path upstream of the platen 2. The pin tractors 14 are supported on a transmission shaft 15 and a guide shaft 16 which extend parallel to the platen 2 and are rotatably supported on the printer frame 1. The pin tractors 14 are laterally movable on the shafts 15, 16 for positional adjustment in the transverse direction of a continuous sheet Q. Each of the pin tractors 14 has a drive pulley 17 rotatable with the transmission shaft 15 and a driven pulley 18 rotatable on the guide shaft 16. A circulatory pin belt 19 having a plurality of pins 19*a* is trained around the pulleys 17, 18.

As shown in FIG. 3, the pin tractors 14 serve as a continuous sheet feed means for feeding the continuous sheet Q to the printing mechanism A. With the pins 19*a* of the pin belt 19 engaging in feed holes Q*a* defined in the side marginal portions of the continuous sheet Q, the transmission shaft 15 is rotated about its own axis to move the pin belt 19 in a circulatory path to cause the pins 19*a* to feed the continuous sheet Q.

A drive mechanism for actuating the platen 2 and the pin tractors 14, and a switching means for selecting either a continuous sheet feed mode or a cut sheet feed mode will be described below with reference to FIGS. 3 through 8.

A platen gear 21 is fixed to one end of the platen shaft 3, and similarly a transmission shaft gear 22 is fixed to one end of the transmission shaft 15, both outwardly of one of the side walls la of the printer frame 1. Near the platen gear 21, a two-gear assembly 23 comprising a smallerdiameter gear 23*a* and a larger-diameter gear 23*b* which are rotatable in unison with each other is rotatably supported on the printer frame 1 by a support shaft 24. The platen gear 21 is held in mesh with the smaller-diameter gear 23*a*. The larger-diameter gear 23*b* meshes with a motor gear 26 of a drive motor 25 (see FIG. 3) disposed within the printer frame 1.

Figure 4:
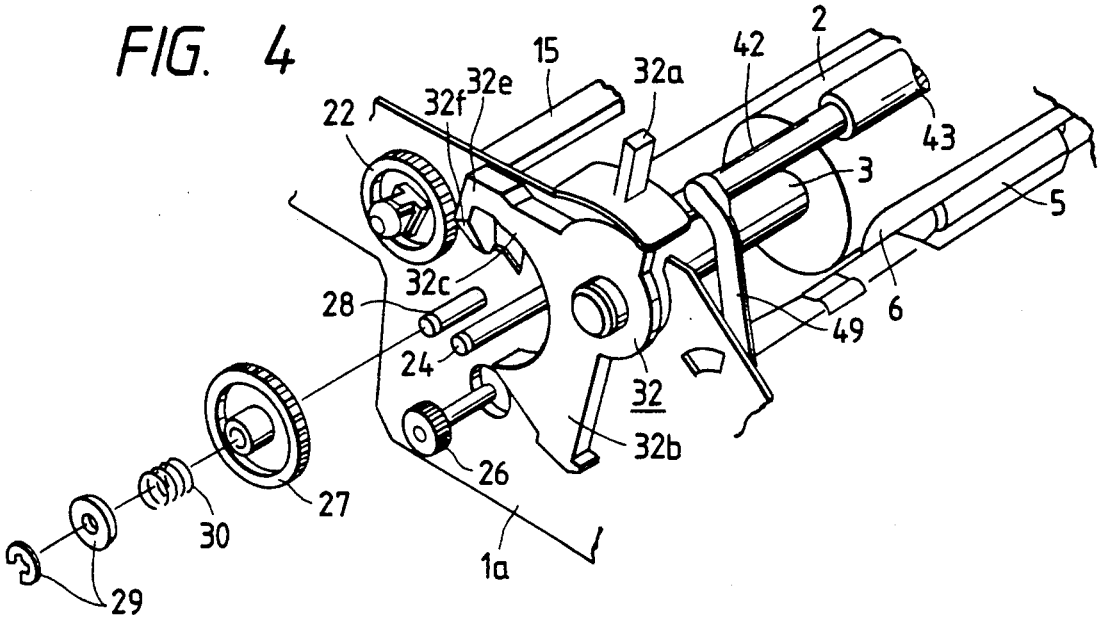
FIG. 4 is a fragmentary exploded perspective view of gears and a switching lever.
Figure 8:
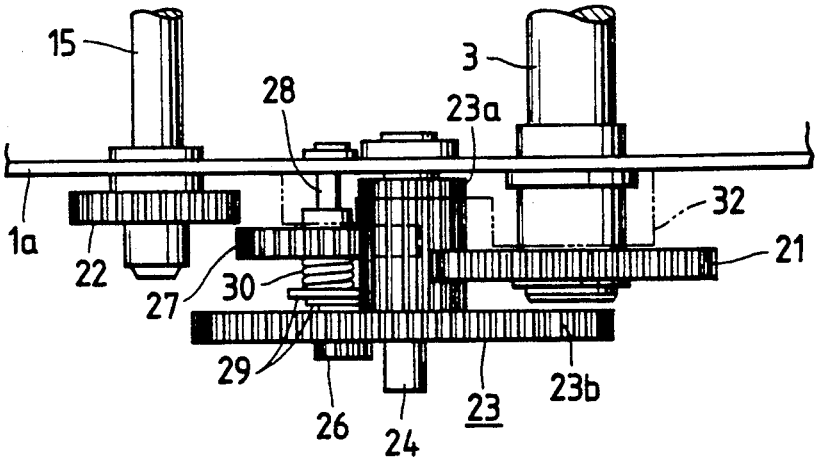
FIG. 8 is a fragmentary plan view illustrative of operation of the clutch gear.

Between the two-gear assembly 23 and the transmission shaft gear 22, there is disposed a clutch gear 27 for selectively transmitting power between the gears 23, 22. More specifically, as shown in FIGS. 3, 4 and 8, a support shaft 28 extends transversely outwardly of one side wall 1*a* of the printer frame 1 and fixed thereto in a cantilevered fashion. The clutch gear 27 is rotatably and axially movably supported on the support shaft 28. Retaining rings 29 are fixed to the distal end of the support shaft 28, and a compression spring 30 is interposed between the retaining rings 29 and the clutch gear 27. The clutch gear 27 is normally urged by the compression spring 30 into an operative position near the printer frame 1, as shown in FIG. 3. In the operative position, the clutch gear 27 is held in mesh with the smaller-diameter gear 23*a* of the two-gear assembly 23 and the transmission shaft gear 22 for transmitting power between these gears 23, 22.

When the clutch gear 27 is moved into an inoperative position away from the printer frame 1 against the bias of the compression spring 30 as shown in FIG. 8, the clutch gear 27 is brought out of mesh with the transmission shaft gear 22 while being held in mesh with the smaller-diameter gear 23*a*. The transmission of power between the gears 23, 22 is now cut off.

Figure 6:
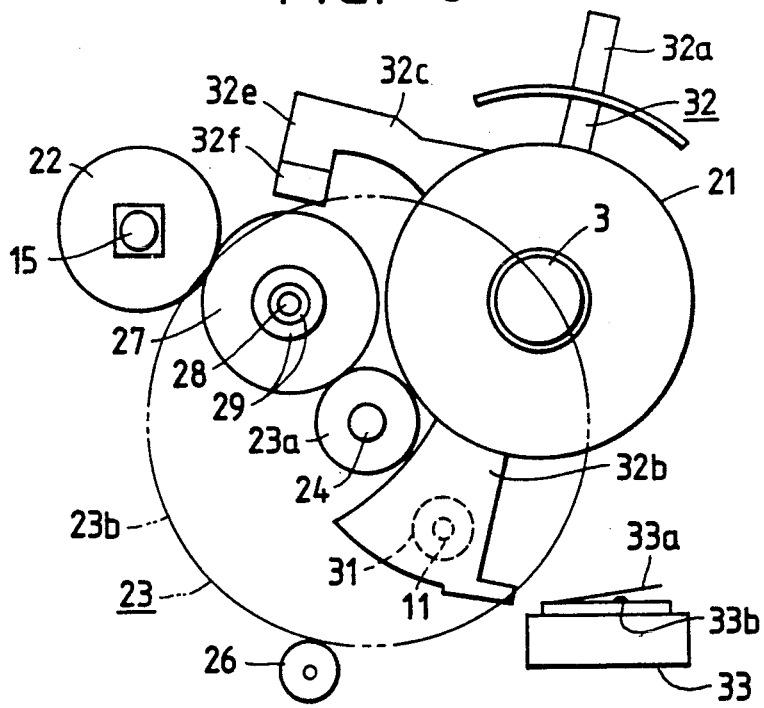
FIG. 6 is a side elevational view of the gears and the switching lever.
Figure 7:
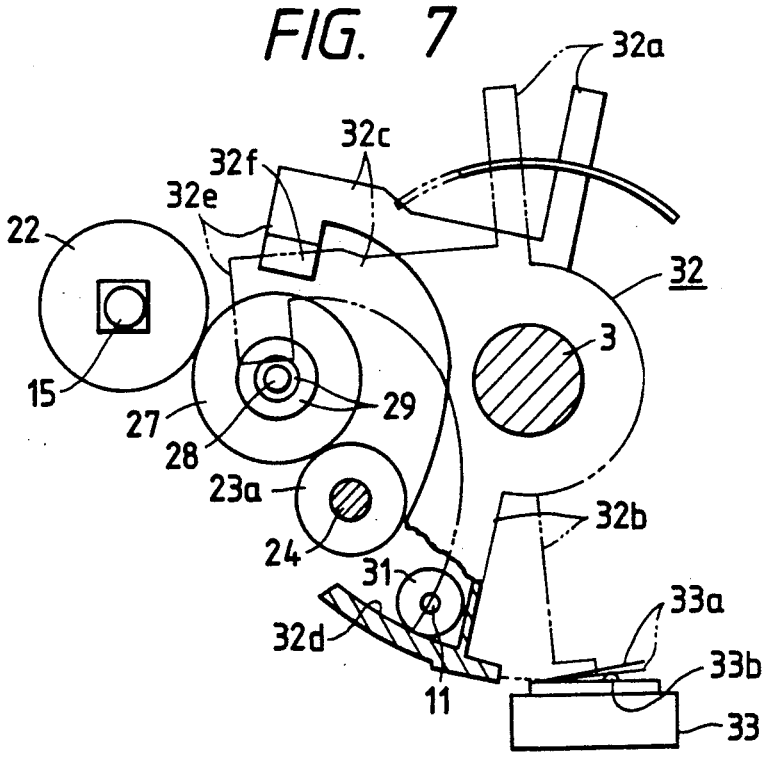
FIG. 7 is a sectional side elevational view showing the manner in which the switching lever is moved and a clutch gear and a switch are in contact with each other.

As shown in FIGS. 6 and 7, an operating shaft gear 31 is fixed to one end of the operating shaft 11 which is operated to vertically move the sheet guide member 6, the operating shaft gear 31 being positioned below the two-gear assembly 23.

A switching lever 32, serving as a switching means, is mounted on one end of the platen shaft 3 for operating the clutch gear 27 to selectively cut off the power transmission and also for selectively bringing the sheet presser rollers 5*a*, 5*b* into and out of contact with the platen 2. More specifically, the switching lever 32 has an operating knob 32*a* that can selectively be moved into two positions, i.e., a continuous sheet position in which the operating knob 32*a* is shifted to the right as indicated by the solid lines in FIG. 7 and a cut sheet position in which the operating knob 32*a* is shifted to the left as indicated by the two-dot-and-dash lines in FIG. 7, for thereby switching between the continuous sheet feed mode and the cut sheet feed mode.

Figure 9:
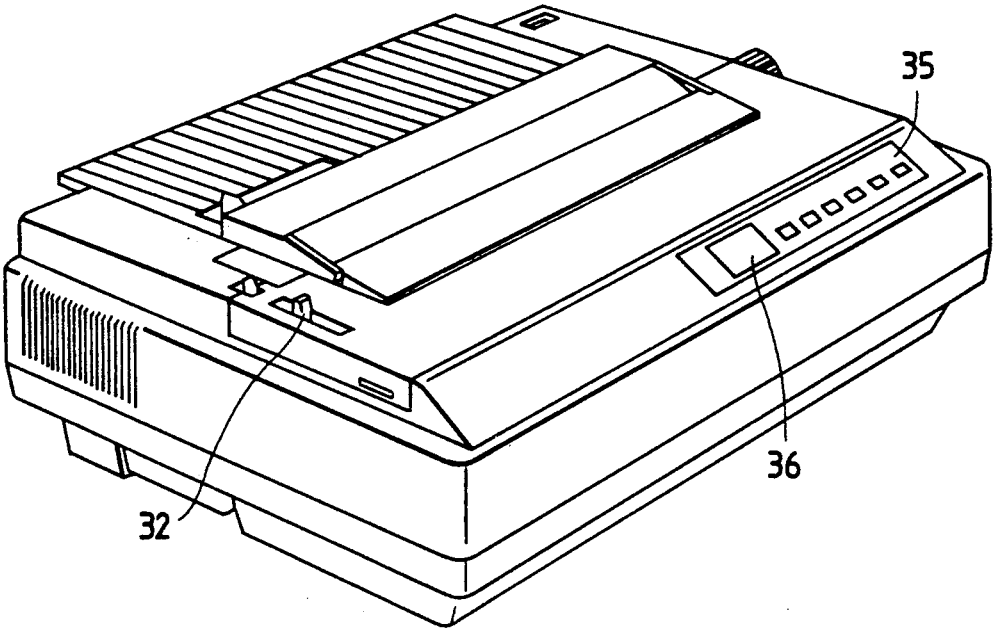
FIG. 9 is a perspective view showing a printer into which the sheet feeder is incorporated.

The switching lever 32 is angularly movably mounted on one side of the platen shaft 3 as seen from FIG. 9, and between the printer frame 1 and the platen gear 21. As shown in FIGS. 4 through 7, the switching lever 32 comprises the upper operating knob 32*a*, a lower operating portion 32*b*, and an arm 32*c* extending laterally from a portion immediately below the operating nob 32*a*. As shown in FIG. 7, an arcuate gear segment 32*d* is formed on an inner surface of the operating portion 32*b* in mesh with the operating shaft gear 31. As shown in FIGS. 4, 6 and 7, an engaging portion 32*e* which is engageable with one side of the clutch gear 27 projects downwardly from the distal end of the arm 32*c*. The engaging portion 32*e* has an engaging slanted surface 32*f* facing toward the compression spring 30, for smoothly guiding engagement with the clutch gear 27.

Figure 5:
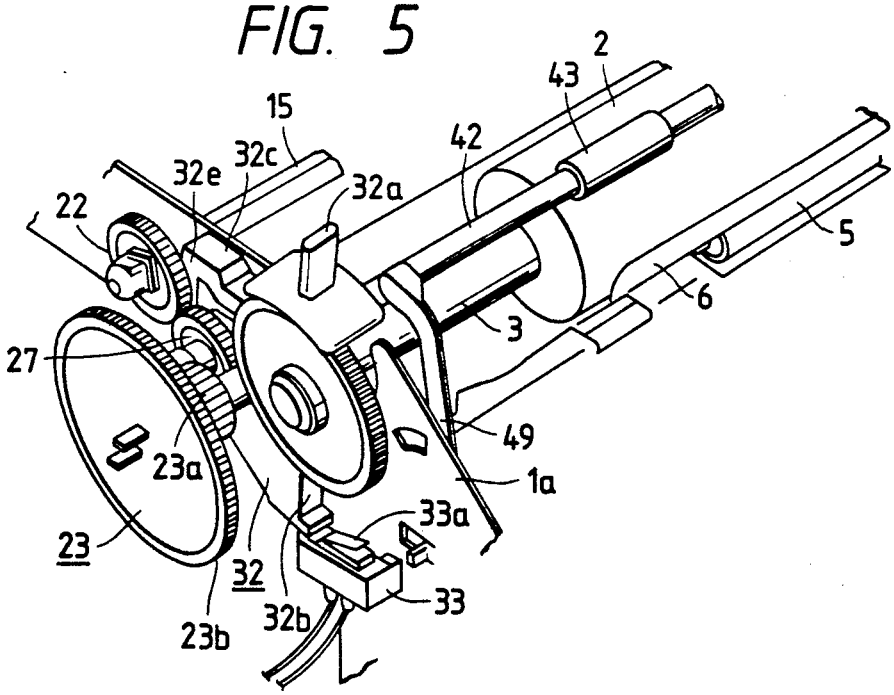
FIG. 5 is a fragmentary exploded view of the gears.

As shown in FIGS. 5 through 7, a switch 33 is attached to an outer surface of the printer frame 1, which is engageable with a portion of the operating portion 32*b* to detect the selected position of the switching lever 32. The switch 33 serves as a position detecting means for detecting the selected position of the switching lever 32. The switch 33 is a normally-open switch comprising a movable contact 33*a* and a fixed contact 33*b*. When the operating portion 32*b* of the switching lever 32 engages the movable contact 33*a* and shifts the same into contact with the fixed contact 33*b*, the switch 33 is turned on. When the output of the switch 33 indicates that the continuous sheet Q has been selected, a control unit (not shown) executes a program for the continuous sheet and rotates the drive motor 25. In addition, the control unit displays a string of characters or symbols, such as "FORM", to thereby indicate that the continuous sheet Q has been selected. When, on the other hand, the output of the switch 33 indicates that the cut sheet P has been selected, the control unit executes a program for the cut sheet and displays a different string of characters or symbols, such as "SHEET" to thereby indicate that the cut sheet P has been selected.

An alarm buzzer 34 is mounted on an inner surface of the side wall 1*a*, which serves as an indicator means for indicating that the cut sheet P or the continuous sheet Q which is loaded does not match the selected position of the switching lever 32. When the continuous sheet Q or the cut sheet P is loaded, but the switching lever 32 is shifted to the wrong feed mode, the alarm buzzer 34 is energized.

When the operating knob 32*a* of the switching lever 32 is shifted into the continuous sheet position as indicated by the solid lines in FIG. 7, the operating portion 32*b* disengages from the switch 33, which is then turned off, and the engaging portion 32*e* on the distal end of the arm 32*c* disengages from the clutch gear 27, whereby the clutch gear 27 is held in mesh with both the two-gear assembly 23 and the transmission shaft gear 22 for the power transmission therebetween. The gear segment 32*d* of the operating portion 32*b* meshes with the operating shaft gear 31 and causes the operating shaft 11 to tilt the operating member 9 as indicated by the two-dot-and-dash lines in FIG. 2, thereby holding the sheet guide member 6 and the sheet presser rollers 5*a*, 5*b* spaced apart from the platen 2. At this time, the retaining force change-over plate 45 is supported on the step 45 of the operating shaft 11 as shown in FIG. 2.

Now, the drive motor 25 is energized to rotate the two-gear assembly 23 through meshing engagement of the motor gear 26 and the larger-diameter gear 23*b*. The platen gear 21 is also rotated to rotate the platen shaft 3. At the same time, the transmission shaft 15 is rotated through the smaller-diameter gear 23*a*, the clutch gear 27, and the transmission shaft gear 22 to move the pin belt 19 along the circulatory path. Therefore, the continuous sheet Q is fed in the continuous sheet feed mode.

When the operating knob 32*a* of the switching lever 32 is in the cut sheet position as indicated by the two-dot-and-dash lines in FIG. 7, the operating portion 32*b* engages the movable contact 33*a* of the switch 33, which is then turned on, and the engaging portion 32*e* pushes the clutch gear 27 out of mesh with the transmission shaft gear 22 against the bias of the compression spring 30. The transmission of power between the two-gear assembly 23, the clutch gear 27, and the transmission shaft gear 22 is now cut off. Only the platen 2 is rotated in accordance with the rotation of the drive motor 15. As the switching lever 32 is thus shifted, the gear segment 32*d* meshing with the operating shaft gear 31 causes the operating shaft 11 to tilt the operating member 9 under the resiliency of the tension spring 10 as indicated by the solid lines in FIGS. 1 and 2, so that the sheet guide member 6 is pushed upwardly to hold the sheet presser rollers 5*a*, 5*b* against the platen 2.

At this time, the operating shaft 11 is rotated in counterclockwise direction in FIG. 2, and the plate 45 shifts from the position shown in FIG. 2 to the position shown in FIG. 1. In this shifted position, the retaining force of the paper bail 40 against the platen 2 is increased to about 1.57 times as illustrated in FIG. 12. That is, the cut sheet P is retained against the platen with a stronger force in comparison with the continuous sheet Q. Therefore, even in the case of a small-size and resilient cut sheet, such as postcard, the printing can be perfectly achieved without disturbing or displacing the print lines at the bottom portion of the sheet.

The drive motor 25 is now energized to enable the motor gear 26 to rotate the two-gear assembly 23 through meshing engagement between the motor gear 26 and the larger-diameter gear 23*b*. The platen shaft 3 is rotated through the platen gear 21 to rotate the platen 2. At this time, the cut sheet P is fed by both the platen 2 and the sheet presser rollers 5*a*, 5*b*. Since no power is transmitted from the smaller-diameter gear 23*a* to the transmission shaft gear 22, the pin belt 19 is not moved in the circulatory path.

Figure 10:
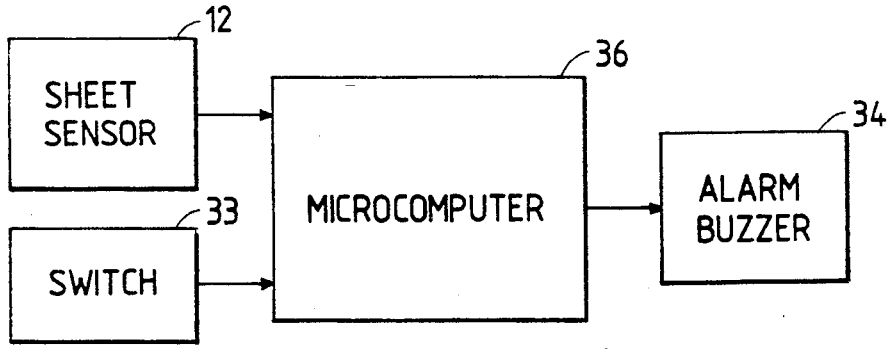
FIG. 10 is a block diagram of an electric arrangement of the sheet feeder.

An electric arrangement of the sheet feeder will be described below with reference to the block diagram of FIG. 10. A microcomputer 36, serving as a control means, is operated according to a control program stored in a memory (not shown) provided in association with the microcomputer 36. The microcomputer 36 is supplied with a sheet detecting signal from the sheet sensor 12, and a continuous sheet feed signal or a cut sheet feed signal from the switch 33. Based on the supplied signals, the microcomputer 36 determines whether the continuous sheet Q or the cut sheet P is appropriately loaded or not, i.e., whether the selected position of the switching lever 32 matches the sheet P or Q which is loaded. If the selected position of the switching lever 32 does not match the loaded sheet, then the microcomputer 36 stops print data to be supplied to the print head 4 and produces a control signal to energize the alarm buzzer 34.

Figure 11:
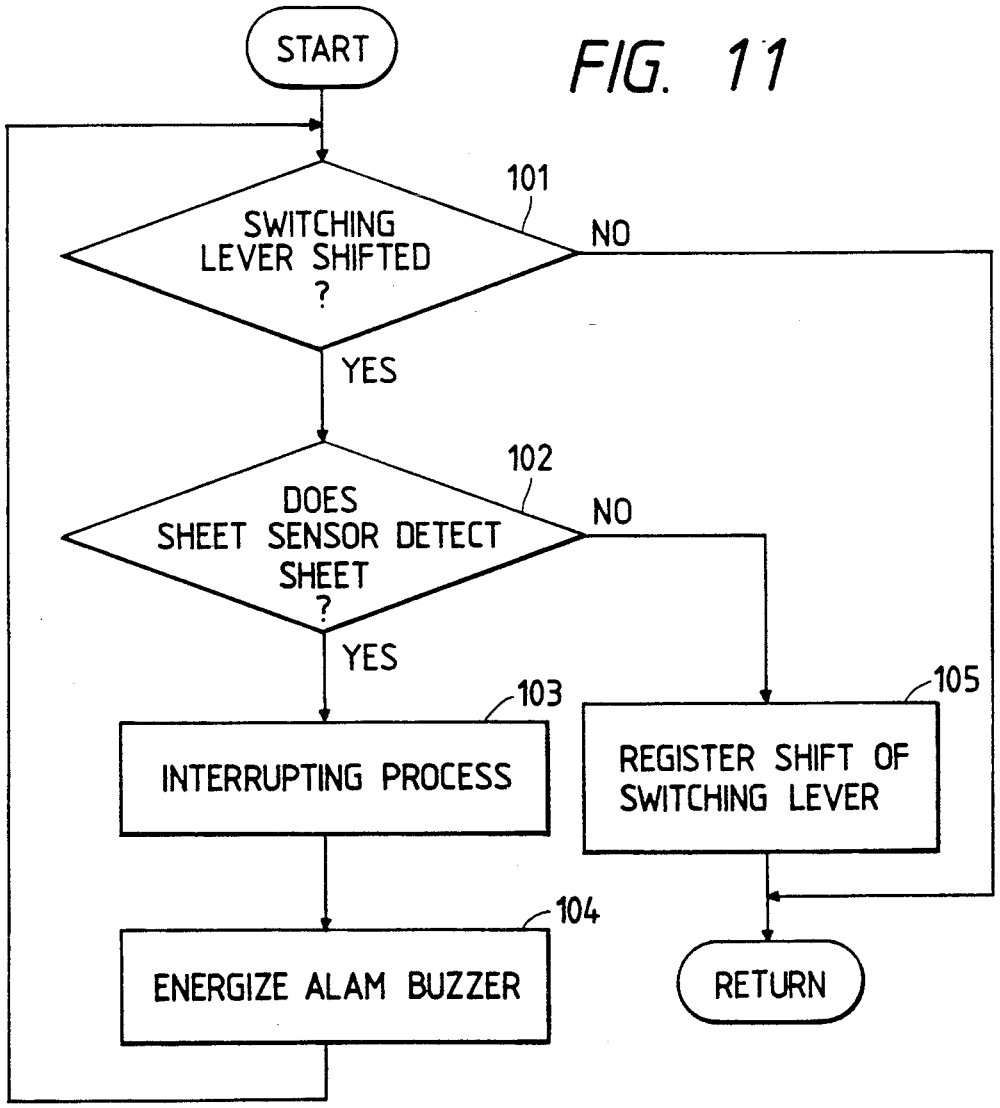
FIG. 11 is a flow chart of a processing sequence of a microcomputer.

Operation of the sheet feeder of the above construction will hereinafter be described with reference to the flow chart of FIG. 11. The flow chart represents a control sequence of the microcomputer 36.

It is assumed that the switching lever 32 is in the cut sheet position as indicated by the two-dot-and-dash lines in FIG. 7, and the printer is in an idling condition with the cut sheet P gripped between the platen 2 and the sheet presser rollers 5*a*, 5*b* as shown in FIG. 1. The microcomputer 36 determines whether the switching lever 32 is shifted or not in step 101. More specifically, the microcomputer 36 determines whether the presently selected position of the switching lever 32 is different from the previously selected position, based on a flag in the memory. If the microcomputer 36 determines that the switching lever 32 is not shifted under the condition where the cut sheet P is being loaded, then control goes back to step 101.

If it is found that the switching lever 32 is shifted, i.e., if the shifting lever 32 is shifted into the continuous-form position as indicated by the solid lines in FIGS. 6 and 7 and the switch 33 is turned off, then control proceeds to step 102 in which it is determined whether the sheet (cut sheet P in this case) is present or not based on the signal from the sheet sensor 12.

If the sheet is detected by the sheet sensor 12, the microcomputer 36 determines that the switching lever 32 is shifted regardless of the cut sheet P being loaded, and control goes to step 103 in which an interrupting process is executed by stopping the output of print data to the print head 4. Then, control goes to step 104 in which the alarm buzzer 34 is energized to indicate to the operator that the sheet being loaded does not match the selected position of the switching lever 32.

As a result, the operator knows that the switching lever 32 has been shifted to the continuous sheet position irrespective of the cut sheet P being loaded. The operator can then take a suitable measure such as shifting back the switching lever 32 to the cut sheet position. Consequently, the continuous sheet is prevented in advance from being fed while the printer is in the cut sheet feed mode in which print data will be printed on the cut sheet P.

If no sheet is detected by the sheet sensor 12 in step 102, the microcomputer 36 determines that the printer runs out of sheets and a sheet will be loaded, i.e., it determines that the switching lever 32 is shifted in order to load another cut sheet P, and then, control goes to step 105. In step 105, the alarm buzzer 34 is not energized, and a flag in the memory is changed so that it indicates the continuous sheet feed mode rather than the cut sheet feed mode. Thereafter, control returns to step 101.

When the switching lever 32 is shifted again from the continuous sheet position to the cut sheet position, steps 101, 102 and 105 are executed, and the flag in the memory is changed so that it indicates the cut sheet feed mode rather than the continuous sheet feed mode. Therefore, the printer is in the condition in which print data will be printed on the other cut sheet P loaded.

The process in which a cut sheet P is to be printed has been described above. However, when a continuous sheet Q is to be printed, an erroneous shifting operation of the switching lever 32 can be indicated by the alarm buzzer 34.

With the above-described embodiment, if the switching lever 32 is not shifted to match the type of a sheet to be printed, then such an erroneous position of the switching lever 32 is indicated by the alarm buzzer 34. Therefore, a sheet which is different from the sheet setting indicated by the switching lever is prevented from being supplied to the printing mechanism A. Accordingly, print data can be printed on a proper sheet.

Further, various operations of the sheet feeder, such as shifting of the sheet presser rollers between two positions adapted to selectively feed the cut sheet and the continuous sheet, power transmission to the platen 2 and the pin tractors 14, and derivation of the output of the switch 33 indicating the selected sheet feed mode, can be collectively performed at a time. As such, the number of manipulations for effecting the switching between the cut sheet feed mode and the continuous sheet feed mode can be reduced.

Although the present invention has been described with reference to a specific embodiment, it should be understood that various changes and modifications may be made without departing from the scope and spirit of the present invention. For example, while the alarm buzzer 34 is employed as the indicator means, an alarm lamp is available, or a combination of the alarm buzzer 34 and such an alarm lamp may be employed. Although the output of print data to the print head 4 is interrupted and the alarm buzzer 34 is energized when the switching lever 32 is erroneously shifted, the interruption of the output of print data to the print head 4 may be omitted. Further, although it has been described that the sheet presser rollers are brought to the spaced apart position from the platen when the continuous sheet is to be fed, they may be remained in contact with the platen if the rollers are held against the platen with a weaker force. According to the embodiment, the pin tractor is described so that it is disposed upstream of the platen 2, it may be disposed downstream thereof or two pin tractors may be disposed in both upstream and downstream of the platen 2.

As described in detail above, the present invention offers the advantages of preventing a sheet from being torn off, a sheet feed failure, and a paper jam which would otherwise result from an erroneous operation of an operating means.

What is claimed is:

1. A sheet feeder for a printer comprising:

a frame;

a printing mechanism including a planten rotatably supported on said frame and a print head reciprocally movable along said platen, said print mechanism carrying out printing on a sheet loaded in said printing mechanism;

a drive source;

continuous sheet feed means connected to said drive source for feeding a continuous sheet;

cut sheet feed means connected to said drive source for feeding a cut sheet;

switching means for connecting said drive source to selective one of said continuous sheet feed means and said cut sheet feed means, said switching means being movable between a first position and second position wherein said cut sheet feed means is selectively driven when said switching means is in the first position and said continuous sheet feed means is selectively driven when said switching means is in the second position;

position detecting means for detecting the position of said switching means and indicating the position thus detected;

sheet detecting means for detecting the sheet loaded in said printing mechanism;

indicator means; and control means for actuating said indicator means when said position detecting means indicates that the position of said switching means is moved from the first position to the second position while said sheet detecting means is detecting the cut sheet loaded in said printing mechanism and also actuating said indicator means when said position detecting means indicates that the position of said switching means is moved from the second position to the first position while said sheet detecting means is detecting the continuous sheet loaded in said printing mechanism.

2. A printer according to claim 1, further comprising sheet pressing means for pressing the sheet loaded in said print mechanism against said platen, said sheet pressing means being movable between a third position and a fourth position wherein when the cut sheet is fed by said cut sheet feed means, said sheet pressing means is moved to the third position to hold the cut sheet against said platen with a first force and wherein when the continuous sheet is fed by said continuous sheet feed means, said sheet pressing means is moved to the fourth position to hold the continuous sheet against said platen with a second force, the first force being greater than the second force.

3. A printer according to claim 2, wherein said second force is zero in magnitude.

4. A printer according to claim 2, wherein said cut sheet feed means comprises said platen and said sheet pressing means, said platen being rotated by said drive source when said switching means connects said drive source to said cut sheet feed means.

5. A printer according to claim 4, wherein said continuous sheet feed means comprises a pair of pin tractors disposed in side marginal portions of the continuous sheet, each pin tractor having an endless belt formed with a plurality of pins and being rotatable in a circulatory path, the pins being adapted to engage holes formed at the side marginal portions of the continuous sheet, the continuous sheet being entrained by the endless belt in accordance with the rotations thereof, the endless pin belt being rotated by said drive source when said switching means connects said drive source to said continuous sheet feed means.

6. A printer according to claim 5, wherein said switching means comprises a switching lever and a power transmission mechanism connected to said drive source, said power transmission mechanism being selectively brought to a first state in which to connect said drive source to said platen and a second state in which to connect said drive source to both said platen and said pin tractor.

7. A printer according to claim 6, wherein said switching lever is operatively coupled to said position detecting means, said sheet pressing means and said power transmission mechanism.

8. A printer according to claim 7, further comprising sheet retaining means for retaining the sheet onto said platen, a spring having one end attached to said sheet retaining means for imparting a retaining force to said sheet retaining means, and retaining force magnitude changing means connected to another end of said spring for changing a magnitude of the retaining force, and wherein said retaining force magnitude changing means changes an orientation of said spring to thereby change the magnitude of the retaining force imparted to said sheet retaining means when said switching means is moved between the first position and the second position.

9. A printer according to claim 8, wherein a first retaining force is imparted to said sheet retaining means when said switching means is in the first position and a second retaining force is imparted thereto when said switching means is in the first position, the second retaining force being greater than the second retaining force.

10. A printer according to claim 1, further comprising sheet retaining means for retaining the sheet onto said platen, a spring having one end attached to said sheet retaining means for imparting a retaining force to said sheet retaining means, and retaining force magnitude changing means connected to another end of said spring for changing a magnitude of the retaining force, and wherein said retaining force magnitude changing means changes an orientation of said spring to thereby change the magnitude of the retaining force imparted to said sheet retaining means when said switching means is moved between the first position and the second position.

11. A printer according to claim 10, wherein when the cut sheet is fed by said cut sheet feed means, a first retaining force is imparted to said sheet retaining means to retain the cut sheet onto said platen and wherein when the continuous sheet is fed by said continuous sheet feed means, a second retaining force is imparted thereto to retain the continuous sheet onto said platen, the first retaining force being greater than the second retaining force.

12. A printer according to claim 11, further comprising sheet pressing means for pressing the sheet loaded in said printing mechanism against said platen, said sheet pressing means being movable between a third position and a fourth position wherein when the cut sheet is fed by said cut sheet feed means, said sheet pressing means is moved to the third position to hold the cut sheet against said platen with a first force and wherein when the continuous sheet is fed by said continuous sheet feed means, said sheet pressing means is moved to the fourth position to hold the continuous sheet against said platen with a second force, the first force being greater than the second force.

13. A printer according to claim 12, wherein said second force is zero in magnitude.

14. A printer according to claim 12, wherein said cut sheet feed means comprises said platen and said sheet pressing means, said platen being rotated by said drive source when said switching means connects said drive source to said cut sheet feed means.

15. A printer according to claim 14, wherein said continuous sheet feed means comprises a pair of pin tractors disposed in side marginal portions of the continuous sheet, each pin tractor having an endless belt formed with a plurality of pins and being rotatable in a circulatory path, the pins being adapted to engage holes formed at the side marginal portions by the continuous sheet, the continuous sheet being entrained by the endless belt in accordance with the rotations thereof, the endless pin belt being rotated by said drive source when said switching means connects said drive source to said continuous sheet feed means.

16. A printer according to claim 15, wherein said switching means comprises a switching lever and a power transmission mechanism connected to said drive source, said power transmission mechanism being selectively brought to a first state in which to connect said drive source to said platen and a second state in which to connect said drive source to both said platen and said pin tractor.

17. A printer according to claim 16, wherein said switching lever is operatively coupled to said position detecting means, said sheet pressing means, said retaining force magnitude changing means and said power transmission mechanism for jointly actuating the same in accordance with the movement of said switching lever between the first and second positions.

* * * * *

UNITED STATES PATENT AND TRADEMARK OFFICE

CERTIFICATE OF CORRECTION

PATENT NO. : 5,087,142

DATED : February 11, 1992

INVENTOR(S) : Hiroshi Suzuki et al

It is certified that error appears in the above-identified patent and that said Letters Patent is hereby corrected as shown below:

The sheet of drawing consisting of Fig. 12, should be added as shown on the attached page.

Signed and Sealed this

Thirtieth Day of November, 1993

*Attest:*

*Attesting Officer*

BRUCE LEHMAN

*Commissioner of Patents and Trademarks*